US010399368B2

(12) United States Patent
Kawajiri

(10) Patent No.: US 10,399,368 B2
(45) Date of Patent: Sep. 3, 2019

(54) PRINTING DEVICE AND CONTROL METHOD OF A PRINTING DEVICE

(71) Applicant: Seiko Epson Corporation, Tokyo (JP)

(72) Inventor: Masahiro Kawajiri, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/467,547

(22) Filed: Mar. 23, 2017

(65) Prior Publication Data

US 2017/0282610 A1 Oct. 5, 2017

(30) Foreign Application Priority Data

Mar. 30, 2016 (JP) ..... 2016-067507

(51) Int. Cl.
*B41J 15/00* (2006.01)

(52) U.S. Cl.
CPC ..... *B41J 15/005* (2013.01)

(58) Field of Classification Search
CPC . B41J 15/16; B41J 15/165; B41J 15/04; B41J 13/0009; B41J 15/005; B41J 29/393; B41J 15/046; B41J 15/02
USPC ..... 347/14, 16, 19, 101, 104
See application file for complete search history.

(56) References Cited

U.S. PATENT DOCUMENTS 7,150,573 B2 12/2006 Cummins et al.
2014/0192108 A1* 7/2014 Horaguchi ..... B41J 11/007 347/16

FOREIGN PATENT DOCUMENTS

| | | | |
|---|---|---|---|
| JP | 60-006549 | A | 1/1985 |
| JP | 62-171858 | A | 7/1987 |
| JP | 08-113403 | A | 5/1996 |
| JP | 08-164644 | A | 6/1996 |
| JP | 2012-148865 | A | 8/2012 |
| JP | 2013-063821 | A | 4/2013 |
| JP | 2014-177318 | A | 9/2014 |

* cited by examiner

*Primary Examiner* — Jannelle M Lebron
(74) *Attorney, Agent, or Firm* — Workman Nydegger

(57) ABSTRACT

A printing device reduces the load on the reel driver that drives a delivery reel. A controller drives a reel driver to turn at multiple drive speeds, including a minimum speed at which the circumferential speed of a media roll of the largest diameter is equal to, and a maximum speed at which the circumferential speed of a media roll of the smallest diameter is equal to, the conveyance speed of the media conveyor. When the amount of slack detected by a slack detector goes from between a first threshold and a second threshold that is less than the first threshold, to an amount of slack less than the first threshold, the controller changes the drive speed to one higher speed if the reel driver is not turning at the maximum speed, and stops the reel driver if the reel driver is turning at the maximum speed.

4 Claims, 4 Drawing Sheets

PRINTING DEVICE AND CONTROL METHOD OF A PRINTING DEVICE

CROSS REFERENCE TO RELATED APPLICATION

The present application claims priority under 35 U.S.C. § 119 to Japanese Patent Application No. 2016-067507 filed on Mar. 30, 2016 in Japan. The disclosure of which is incorporated herein by reference in its entirety.

BACKGROUND

1. Technical Field

The present invention relates to a printing device and control method of a printing device that delivers rolled print media for printing.

2. Related Art

Printing devices (printers) that deliver and convey a web from a web roll of a continuous web wound into a roll, and form images by an electrophotographic method, are known from the literature. See, for example, JP-A-2013-63821.

The printer described in JP-A-2013-63821 has a paper feed device that supports a web roll so that the web can be delivered therefrom; an air loop mechanism that forms an air loop (slack) in the web delivered from the paper feed device; a web conveyance mechanism that is located downstream from the air loop mechanism and conveys the web; a transfer unit with a photoconductor drum located downstream from the web conveyance mechanism; and a fuser assembly located downstream from the transfer unit. By forming an air loop in the web with the air loop mechanism, the delivery load of the paper feed device is not applied to the web conveyance mechanism.

The air loop mechanism has a box that holds the air loop; a web pulling mechanism that pulls the web from the paper feed device into the box and forms an air loop in the box; and an air loop detector that detects the amount of slack in the air loop. The air loop detector comprises a first sensor, second sensor, third sensor, and fourth sensor disposed sequentially from top to bottom inside the box.

Control of the air loop includes first air loop control and second air loop control, which are alternately applied to control the amount of slack in the air loop. When the slack in the air loop increases and the third sensor detects the air loop, the first air loop control reduces the conveyance speed of the web pulling mechanism. As the slack in the air loop decreases and the third sensor again detects the air loop, the first air loop control increases the conveyance speed of the web pulling mechanism. In other words, the first air loop control repeatedly increases and decreases the web conveyance speed at the third sensor. The second air loop control similarly repeatedly increases and decreases the web conveyance speed at the fourth sensor. By repeatedly alternating between first air loop control and second air loop control, sensor malfunctions can be discovered. When the first sensor does not detect the air loop during first air loop control, and when the second sensor does not detect the air loop during second air loop control, an upper limit error is detected and the web conveyance mechanism is stopped.

The printing device of the related art thus repeatedly increases and decreases the speed of web conveyance triggered by the third sensor detecting the web during first air loop control, and repeatedly increases and decreases the speed of web conveyance triggered by the fourth sensor detecting the web during second air loop control. As a result, the motor of the web pulling mechanism repeatedly turns on and off, and the inertial load of turning and stopping turning of the web roll is repeatedly applied to the motor. As a result, the motor may overheat.

An objective of the present invention is to provide a printing device and a control method of a printing device that can reduce the load of the reel drive mechanism that drives the delivery reel.

SUMMARY

A printing device according to the invention has a media conveyance unit that conveys a print medium; a reel spindle that supports a media roll of the print medium wound into a roll; a reel driver that drives the reel spindle and turns the media roll; a slack detector that detects the amount of slack in the print medium hanging down from the outside circumference of the media roll; and a controller that controls the reel driver based on the detection result of the slack detector. The controller drives the reel driver at a first speed, or a second speed that is greater than the first speed, as the drive speed; controls the slack detector while causing the media conveyance unit to convey the print medium; detects if the amount of slack is between a first threshold and a second threshold that is less than the first threshold; if the detected amount of slack is between the first threshold and second threshold, drives the reel driver at the first speed or the second speed; and if the detected amount of slack is less than the second threshold, changes to the second speed if the reel driver is being driven at the first speed, and stops driving the reel driver if the reel driver is being driven at the second speed.

Another aspect of the invention is a control method of a printing device having a media conveyance unit that conveys a print medium; a reel spindle that supports a media roll of the print medium wound into a roll; a reel driver that drives the reel spindle and turns the media roll; and a slack detector that detects the amount of slack in the print medium hanging down from the outside circumference of the media roll; and driving the reel driver at a first speed, or a second speed that is greater than the first speed, as the drive speed. The control method includes detecting, by the slack detector while the print medium is being fed by the media conveyance unit, if the amount of slack is between first threshold and a second threshold that is less than the first threshold, or is less than the second threshold; driving the reel driver at a first speed or a second speed if the amount of slack is between first threshold and second threshold; and if the amount of slack is less than the second threshold, changing the drive speed to the second speed if the reel driver is driving at the first speed, and stopping driving the reel driver if the reel driver is driving at the second speed.

Because the reel driver in this configuration maintains a specific speed when the amount of slack is between the first threshold and second threshold, the reel driver can be driven at a constant speed for a long time if there is a sufficient difference between the first threshold and second threshold. More specifically, the frequency of starting and stopping driving the reel driver can be reduced, and the load on the reel driver can be reduced. Furthermore, because the speed is changed to the second speed when the detected amount of slack is less than the second threshold and the reel driver is driving at the first speed, the amount of slack can be quickly increased to greater than the second threshold. As a result, a desirable amount of slack can be maintained in the print medium by a simple control method. Furthermore, because the reel driver is stopped when the detected amount of slack is less than the second threshold and the reel driver is driving at the second speed, action to prevent an undesirable slack state, such as damage to the reel driver or the end of the print medium, can be quickly taken. Furthermore, because the slack is formed in the space below the roll of print medium, a space-efficient, simple slack housing can be easily constructed.

It will also be obvious that by creating slack in the rolled print medium, the inertial load (back tension) on the delivery reel side that works on the media conveyance unit can be reduced, and the print medium can be reliably fed with good precision by the media conveyance unit.

Preferably, the slack detector has a first detection unit that detects the first threshold, and a second detection unit that detects the second threshold; and the first detection unit is located vertically below the second detection unit.

In this case, the first detection unit and the second detection unit are preferably transmissive photosensors.

This configuration enables, by a simple configuration, accurately detecting the amount of slack (first threshold and second threshold) in the print medium.

Further preferably, the controller controls the media conveyance unit; and when stopping driving the reel driver when slack less than the second threshold is detected while driving the reel driver at the second speed, stops the media conveyance unit when the amount the media conveyance unit is driven after the reel driver is stopped exceeds a specific amount.

This configuration enables conveying the print medium until the end of the print medium reaches the media conveyance unit even after the end of the print medium is detected. Print medium waste can therefore be reduced.

Further preferably, the printing device has a print unit that prints on the print medium. When stopping driving the reel driver when slack less than the second threshold is detected while driving the reel driver at the second speed, the controller acquires, when it stops the reel driver, the specific length of the print medium the media conveyance unit can convey after the reel driver stopped, and controls the print unit to print if the print job can be printed in the specific length of print medium.

This configuration enables conveying the print medium until the end of the print medium reaches the media conveyance unit even after the end of the print medium is detected, and printing can continue without waste.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of a printing device and control method of a printing device according to the present invention are described below with reference to the accompanying figures. The printing device in this embodiment is a label printer that prints by an inkjet method while delivering and conveying print media (label paper) from a paper roll.

Configuration of the Printing Device

Figure 1:
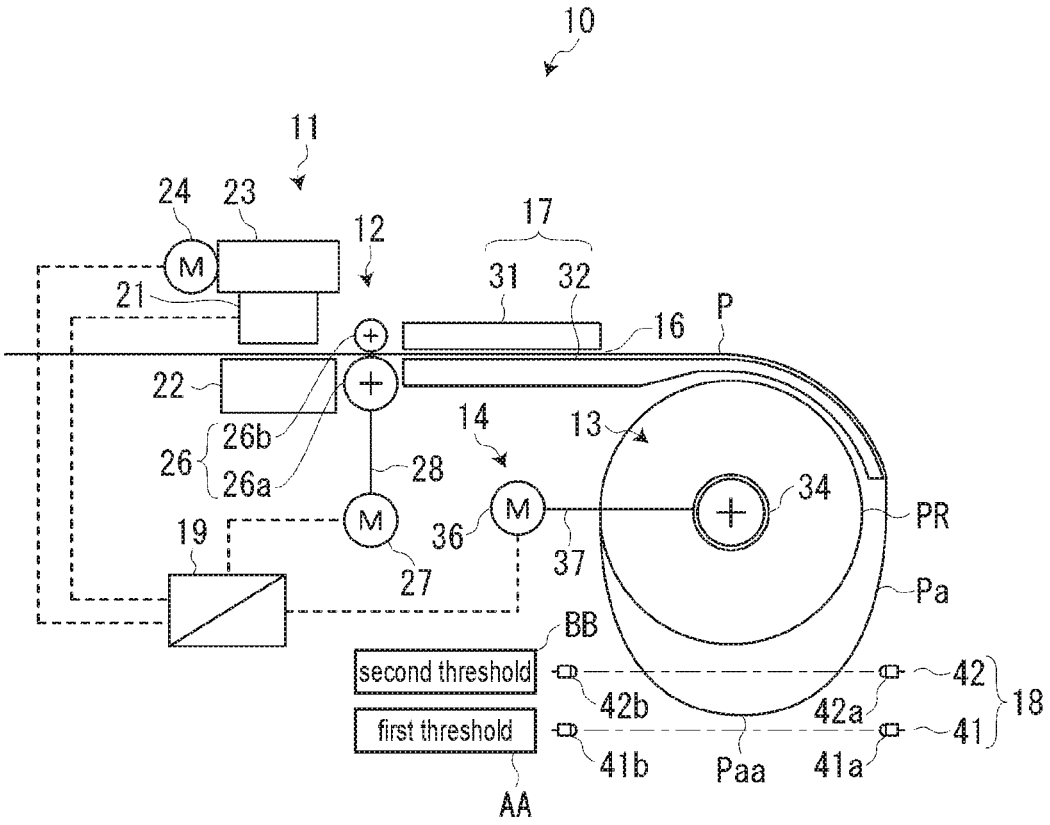
FIG. 1 illustrates the configuration of main parts of the printing device according to the invention.

FIG. 1 illustrates the configuration of main parts of the printing device according to the invention. As shown in the figure, the printing device (printer) 10 has a print unit 11 that prints on the print medium P by an inkjet method; a media conveyor 12 that conveys the print medium P to the print unit 11; a delivery reel 13 that delivers the print medium P wound into a roll (media roll PR) toward the media conveyor 12; and a reel driver 14 that drives the delivery reel 13.

The reel driver 14 drives the delivery reel 13 rotationally, and the delivery reel 13 delivers the print medium P with slack Pa hanging down from the outside circumference of the print medium P wound into a roll (media roll PR). As a result, excessive back tension is not produced on the print medium P conveyed to the print unit 11 by the media conveyor 12.

The printer 10 also has a media guide 17 disposed to the conveyance path 16 of the print medium P from the delivery reel 13 to the media conveyor 12; a slack detector 18 that detects the amount of slack in the slack Pa; and a controller 19 that centrally controls parts of the printer 10. An appropriate amount of slack is maintained in the slack Pa by the controller 19 controlling driving the reel driver 14 based on the detection result from the slack detector 18.

The print unit 11 includes an inkjet printhead 21; a platen that supports the print medium P opposite the printhead 21; and a head moving mechanism 23 that moves the printhead 21 widthwise to the print medium P. While not specifically shown in the figure, the head moving mechanism 23 includes, for example, a carriage that supports the printhead 21, a carriage motor 24 that drives the carriage to move the printhead 21 bidirectionally in the transverse direction; and a drive pulley, driven pulley, timing belt, and guide rail.

The carriage motor 24 is connected to the controller 19, and the controller 19 drives the carriage motor 24 and controls bidirectional movement of the printhead 21 by the head moving mechanism 23. The controller 19 drives the printhead 21 to print while moving the printhead 21 back and forth. Each time the printhead 21 travels out and back in the main scanning direction, the controller 19 intermittently drives the media conveyor 12 to advance the print medium P in the sub-scanning direction.

The media conveyor 12 is near the print unit 11 on the upstream side in the conveyance direction, and conveys the print medium P toward the print unit 11. The media conveyor 12 has a feed roller pair 26 (nip rollers) including a drive roller **26*a* and driven roller 26*b*; a paper feed motor 27 that drives the drive roller 26*a*; and a power transfer mechanism 28 that slows and transfers power from the paper feed motor 27 to the drive roller 26*a*. While not specifically shown in the figures, the power transfer mechanism 28 includes a speed reducing gear train, for example. The paper feed motor 27 is connected to the controller 19, and the controller 19 controls the paper feed motor 27** based on print commands, for example.

The media guide 17 includes a top guide 31 and a bottom guide 32. The gap between the top guide 31 and bottom guide 32 is part of the conveyance path 16, and the print medium P is conveyed between the top guide 31 and bottom guide 32. The top guide 31, printhead 21, head moving mechanism 23, and driven roller **26*b* are attached to an access cover of the device case not shown. The bottom guide 32 extends from near the drive roller 26*a* to a position vertically above the delivery reel 13. The delivery reel 13 side of the bottom guide 32 curves in an arc around the delivery reel 13**, and is configured so that media roll PR does not contact the print medium P delivered from the media roll PR.

The delivery reel 13 has a reel spindle 34 supported to rotate freely. The media roll PR, which is the print medium P wound around a paper core, for example, is set on the reel spindle 34. The printer 10 is a device in which multiple types of print media P of different widths can be used as the printer (media roll PR), and the multiple types of print media P are set on the reel spindle 34 offset to one side of the width of the conveyance path 16.

The reel driver 14 includes a reel motor 36, and a reel transfer mechanism 37 that speed reduces and transfers drive power from the reel motor 36 to the delivery reel 13 (reel spindle 34). A DC motor is used as the reel motor 36 in this example. The reel transfer mechanism 37 includes, for example, a speed reducing gear train and belt transfer mechanism (timing belt). The reel motor 36 is connected to the controller 19, and the controller 19 controls driving the reel motor 36 based on the detection result from the slack detector 18.

As described below, the reel motor 36 is controlled at two speeds, a low speed (first speed) that is appropriate to a media roll PR with a large diameter, and a high speed (second speed) that is appropriate to a media roll PR with a smaller diameter. The first speed is the speed of rotation at which the circumferential speed of a media roll PR of the largest diameter (a new roll) is substantially equal to the conveyance speed of the feed roller pair 26. The second speed is the speed of rotation at which the circumferential speed of a media roll PR of the smallest diameter (near the end of the roll) is substantially equal to the conveyance speed of the feed roller pair 26. In other words, in control based on the amount of slack described below, two speeds of rotation (first speed and second speed) are previously set for the reel motor 36 for each type of media roll PR that may be set on the reel spindle 34.

As shown in FIG. 1, the slack detector 18 has a bottom detector 41 (first detector) at a vertically lower point for detecting if the amount of slack in the slack Pa is less than a first threshold AA, and a top detector 42 (second detector) that is vertically above the bottom detector 41 for detecting if the amount of slack in the slack Pa is less than a second threshold BB. The amount of slack indicated by the first threshold AA is greater than the amount of slack indicated by the second threshold BB. The bottom detector 41 and top detector 42 are transmissive photosensors respectively comprising an emitter 41*a*, 42*a*, and a photodetector 41*b*, 42*b*. The emitter 42*a* and photodetector 42*b* of the top detector 42 are disposed so that the optical axis of the light beam emitted from the emitter 42*a* and delivered by the photodetector 42*b* passes through the top of the range of slack in the slack Pa. The emitter 41*a* and photodetector 41*b* of the bottom detector 41 are disposed so that the optical axis of the light beam emitted from the emitter 41*a* and delivered by the photodetector 41*b* passes through the bottom of the range of slack in the slack Pa. When the amount of slack in the slack Pa is less than the first threshold and greater than or equal to the second threshold, the vertically upper portion of the slack Pa is detected by the top detector 42, and the vertically lower portion of the slack Pa (bottom end Paa) is detected by the bottom detector 41. Note that the bottom detector 41 and top detector 42 are shown with the optical axes thereof parallel, but may be disposed with the optical axes angled.

The slack Pa in the print medium P hangs vertically down from the media roll PR. Detection by the bottom detector 41 of whether or not the slack is less than first threshold AA happens when the slack is relatively large and the bottom end Paa of the slack Pa is near the detection range of the bottom detector 41. When the bottom detector 41 detects a change from there being no slack Pa in the detection range of the bottom detector 41 (referred to below as No_slack Pa) to there being slack Pa in the detection range (referred to below as Is_slack Pa), or detects a change from Is_slack Pa to No_slack Pa, the amount of slack is first threshold AA. In this case, the top detector 42 always detects Is_slack Pa.

Similarly, detection by the top detector 42 of whether or not the slack is less than second threshold BB happens when the slack is relatively small and the bottom end Paa of the slack Pa is near the detection range of the top detector 42. When there is a change from the slack Pa being in the detection range of the top detector 42 to slack Pa not being in the detection range, and when there is a change from the slack Pa not being in the detection range of the top detector 42 to slack Pa being in the detection range, the amount of slack is detected to be second threshold BB. In this case, the bottom detector 41 always detects there is no slack Pa (No_slack Pa). Furthermore, when the bottom detector 41 does not detect slack Pa in the detection range of the bottom detector 41, and the top detector 42 detects slack Pa in the detection range of the top detector 42, the amount of slack in slack Pa is between first threshold AA and second threshold BB.

Control Method

A control method of the printer 10 by the controller 19 is described next with reference to the flow charts in FIG. 2 to FIG. 4. This control method delivers the print medium P that is fed by the media conveyor 12 for printing from the delivery reel 13 while maintaining slack Pa, and controls the reel driver 14 (reel motor 36) so that the amount of slack in the slack Pa is held between first threshold AA and second threshold BB. As described above, the speed of the reel motor 36 is controlled in two levels, a low speed (first speed) appropriate to a media roll PR of the largest diameter, and a high speed (second speed) appropriate to a media roll PR of the smallest diameter.

Figure 2:
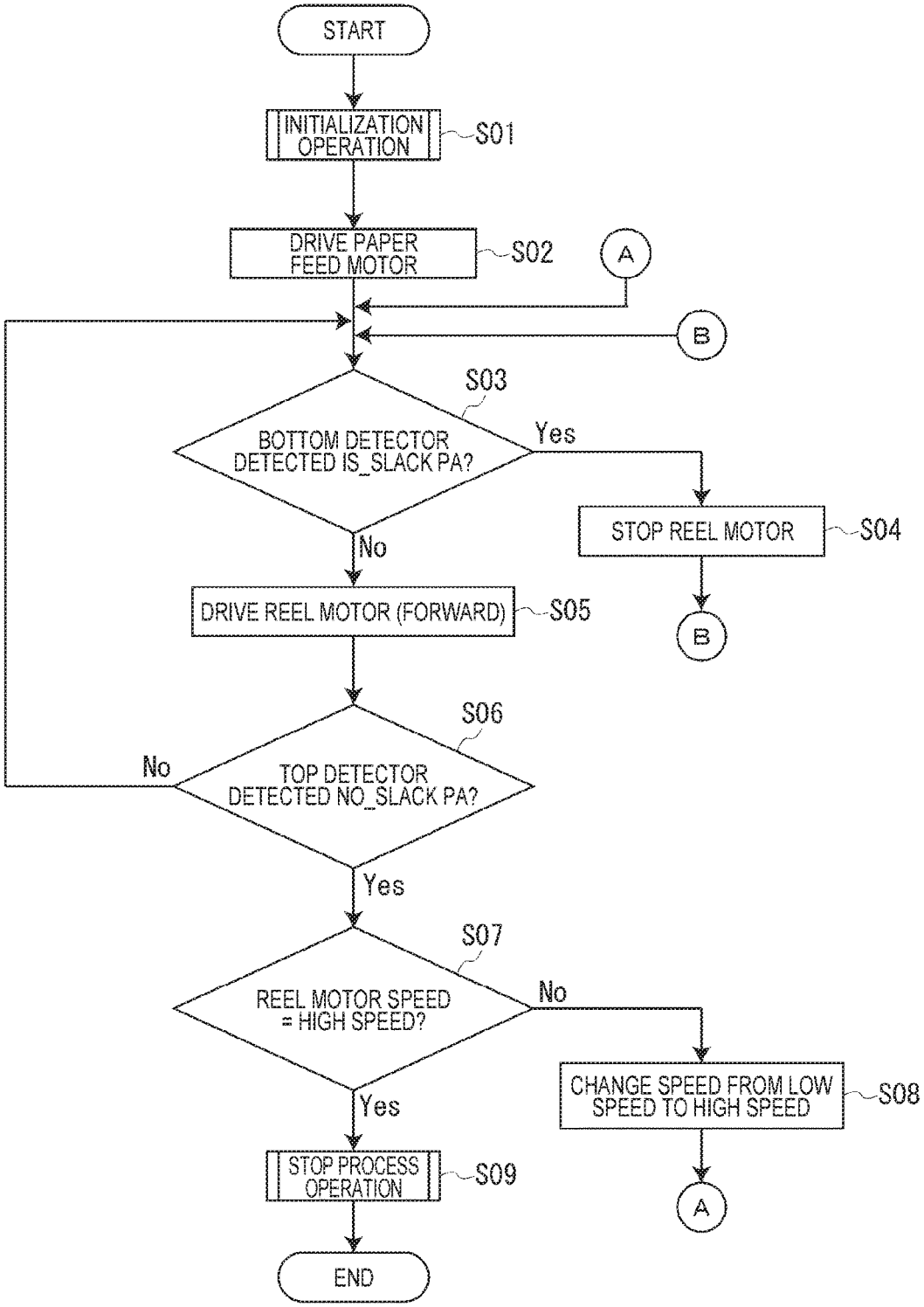
FIG. 2 is a flow chart of steps in the control method of the printing device.
Figure 3:
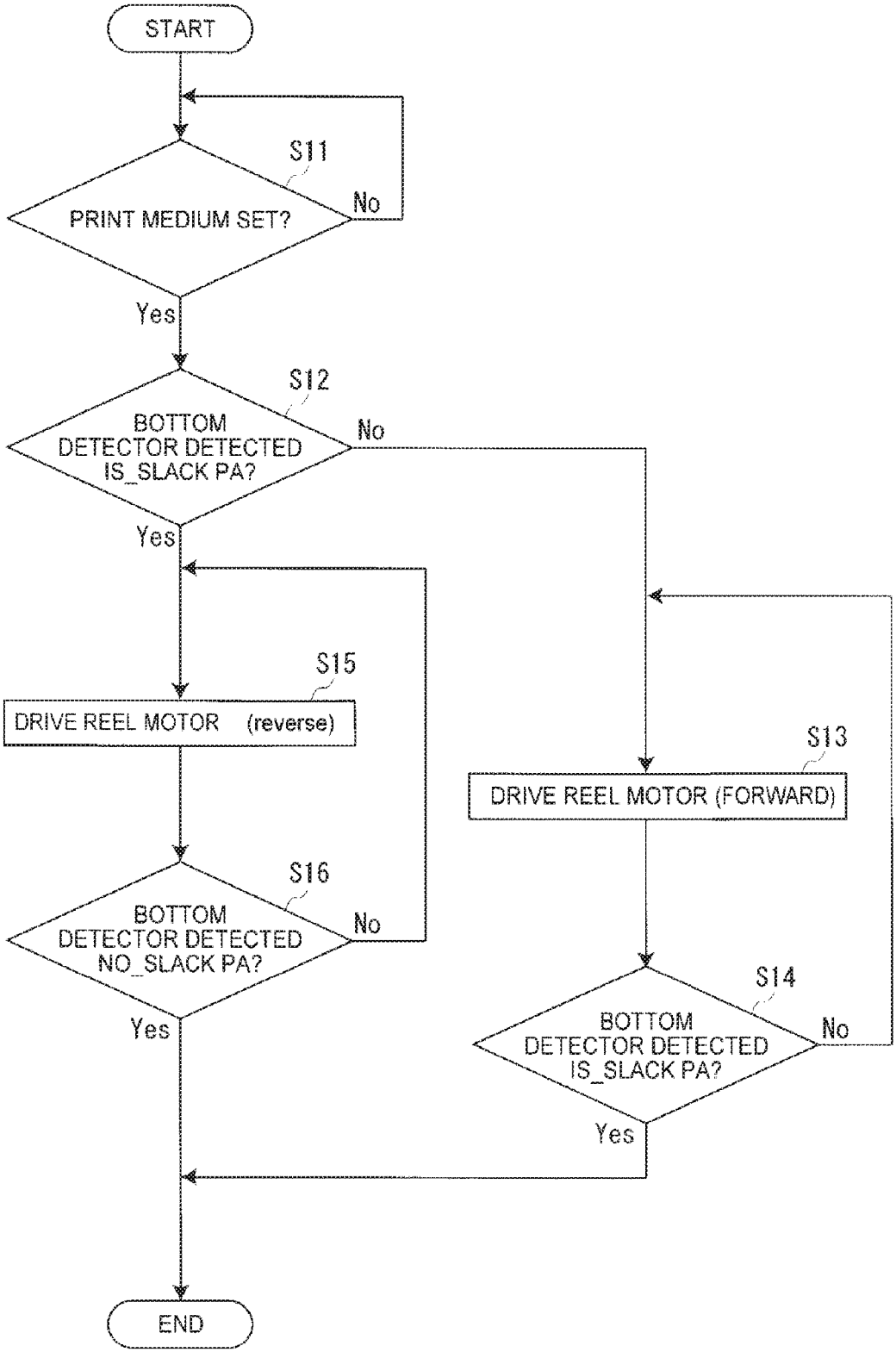
FIG. 3 is a flow chart of steps in the initialization process in the control method of the printing device.

As shown in FIG. 2 and FIG. 3, the controller 19 first executes an initialization operation setting the slack Pa to an initial state (S01).

As shown in FIG. 3, in the initialization operation, the controller 19 first uses a sensor not shown to determine if print medium P is set in the printer 10 (S11). If print medium P is not set (NO), the controller 19 repeats step S11. If print medium P, whether new or not, is set (YES), the controller 19 determines if the bottom detector 41 detected slack Pa (Is_slack Pa) (S12).

If the bottom detector 41 did not detect slack Pa (NO), the controller 19 drives the reel motor 36 (reel driver 14) in the direction delivering print medium P from the media roll PR (S13 and S14) until the bottom detector 41 detects slack Pa (Is_slack Pa), and then ends the initialization operation. However, if the bottom detector 41 detected slack Pa (Is_slack Pa) (YES), the controller 19 drives the reel motor 36 (reel driver 14) in the direction rewinding the print medium P onto the media roll PR (S15 and S16) until the bottom detector 41 detects No_slack Pa, and then ends the initialization operation.

As a result of this initialization operation, the bottom end Paa of the slack Pa is within the detection range of the bottom detector 41, and the amount of slack is substantially at first threshold AA. This state is also referred to as the printing standby (ready to print) state.

As shown in FIG. 2, the controller 19 then starts printing by first starting to drive the paper feed motor 27 (media conveyor 12) (S02). After driving the paper feed motor 27 starts, the controller 19 determines if the bottom detector 41 detected slack Pa (Is_slack Pa) (S03). When the bottom detector 41 detects Is_slack Pa (YES), the controller 19 stops the reel motor 36 (S04) and goes to step S03. If the bottom detector 41 does not detect Is_slack Pa (NO), the controller 19 drives the reel motor 36 in the direction (forward) delivering print medium P from the media roll PR (S05). At this time the bottom end Paa of the slack Pa is between the optical axis of the bottom detector 41 and the optical axis of the top detector 42. The amount of slack is also between first threshold AA and second threshold BB, and the controller 19 drives the reel motor 36 forward at the last speed used in the previous sequence (low speed or high speed).

Print medium P is delivered from the delivery reel 13 by driving the reel motor 36 forward, but as time passes, the diameter of the media roll PR gradually decreases. When the diameter of the media roll PR becomes small, the circumferential speed decreases, and the amount of slack in the slack Pa decreases. In other words, delivery from the delivery reel 13 does not keep up with conveyance by the media conveyor 12 (feed roller pair 26), and the bottom end Paa of the slack Pa gradually rises.

At this point, the controller 19 detects if the top detector 42 does not detect slack Pa (detects No_slack Pa) (S06). If the top detector 42 does not detect No_slack Pa (NO), that is, it detects slack Pa (Is_slack Pa), the controller 19 goes to step S03. If the top detector 42 detected No_slack Pa (YES), the controller 19 determines if the set speed of the reel motor 36 is the high speed setting (S07). If the set speed is not the high speed (NO), that is, the set speed is the low speed, the controller 19 changes the speed setting for forward drive of the reel motor 36 from low speed to high speed (S08), and drives the reel motor 36 forward at the high speed setting. The controller 19 then goes to step S3. If the set speed is the high speed (YES), the controller 19 determines the print medium P is at the end and goes to the stop process operation (S09). Note that before going to the stop process operation, the controller 19 may again determines if the top detector 42 detected No_slack Pa.

Figure 4:
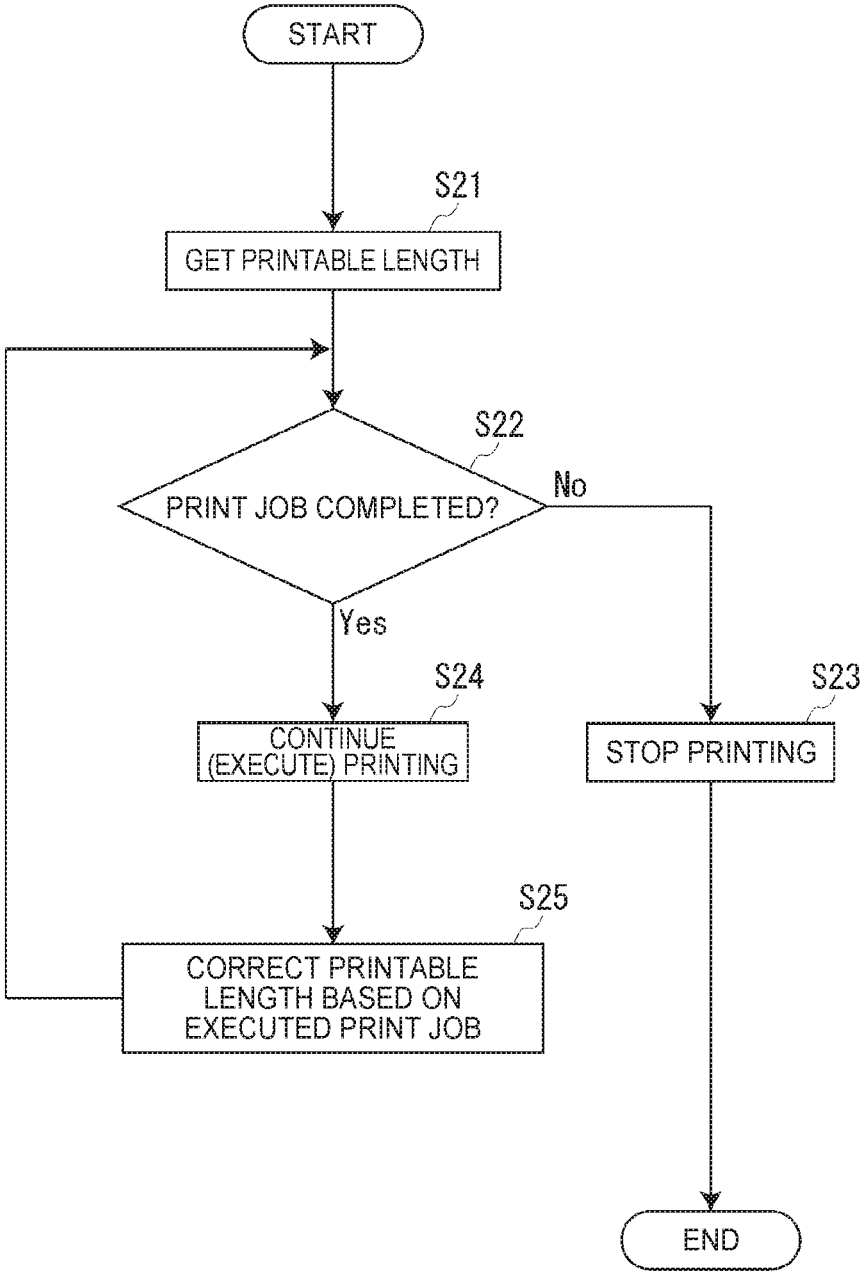
FIG. 4 is a flow chart of steps in the stopping process in the control method of the printing device.

In the stop process operation in FIG. 4, the controller 19 first determines the printable length of the print medium P (S21). The printable length is equivalent to the distance from the end of the print medium P on the conveyance path 16 to the feed roller pair 26 (the distance from the delivery reel 13 to the media conveyor 12) at the time the top detector 42 detected No_slack Pa. The printable length is previously stored in the memory of the controller 19.

Next, the controller 19 determines if the print job can be finished in the acquired printable length (S22). If it determines the print job cannot be finished (NO), the controller 19 stops printing (S23), and ends the stop process operation. When stopping printing, the controller 19 stops driving the printhead 21 and stops driving the paper feed motor 27. Note that driving only the paper feed motor 27 may continue to feed the printable length.

However, if it is determined that the print job can be completed (YES), the controller 19 continues printing (S24). Next, once the print job ends, the controller 19 corrects the printable length by subtracting the printed length of the print job from the printable length (S25), and returns to S22. Note that in this embodiment the print medium P is label paper, and the length of one label on the label paper is the length of one print job. Therefore, when the top detector 42 detects No_slack Pa, printing is possible on multiple labels, and printing continues to the last printable label. Note that when the controller 19 acquires the printable length (S21), the number of printable labels may be calculated from the print data, and printing can continue to the largest whole number (discarding any fractional portion).

As described above, because the reel motor 36 (reel driver 14) in this embodiment maintains the speed of rotation at the time when the amount of slack is between first threshold AA and second threshold BB, if the difference between first threshold AA and second threshold BB is sufficient, rotational drive at the constant speed of the reel motor 36 can be maintained for a long time. The frequency of starting and stopping driving the reel motor 36 can be reduced, and heating of the reel motor 36 can be suppressed.

Furthermore, because the controller 19 stops the reel motor 36 when slack is detected to be greater than or equal to the first threshold AA, the slack can be quickly reduced to less than the first threshold AA. Furthermore, because the controller 19 changes the rotational speed of the reel motor 36 to the high speed setting when the slack is detected to be less than second threshold BB, the slack can be quickly adjusted to greater than or equal to second threshold BB. As a result, the amount of slack in the print medium P can be maintained at a desirable level (that is, less than first threshold AA, and greater than or equal to second threshold BB) by simple control.

However, if the speed of the 36 is already at the high speed setting when the slack is detected to be less than the second threshold BB, the controller 19 determines the end of the print medium P has been reached and stops the reel motor 36 (reel driver 14). As a result, the end of the print medium P can be easily and quickly detected. Therefore, the user of the printer 10 can quickly start replacing the media roll PR. Furthermore, because the controller 19 continues printing as much as possible by print job unit even after the end of the print medium P is detected, print medium P waste can be suppressed.

Furthermore, because the slack Pa in the print medium P is formed directly below the media roll PR, slack Pa can be formed with a simple, space-efficient construction. Furthermore, unnecessary back tension on the print medium P at the media conveyor 12 can be suppressed by the slack Pa, and conveyance precision of the print medium P can be improved. Print quality is therefore also improved.

Note that the reel driver 14 (reel motor 36) is controlled to either of two rotational speed settings, but may be controlled with three or more settings between the low speed and high speed settings.

The print medium P is also described as label paper above, but the invention can also be applied to printers 10 that use paper, film, or other types of continuous media.

Furthermore, the slack detector 18 described above comprises a pair of upper and lower optical sensors, but may be configured in any way that can detect the amount of slack, including a single laser rangefinder.

This application claims priority under 35 U.S.C. § 119 to Japanese Patent Application No. 2016-067507, filed Mar. 30, 2016. The entire disclosure of Japanese Patent Application No. 2016-067507 is hereby incorporated herein by reference.

What is claimed is:

1. A printing device comprising:

a media conveyance unit that conveys a print medium;

a reel spindle that supports a media roll of the print medium wound into a roll;

a reel driver that drives the reel spindle and turns the media roll; and a slack detector that detects the amount of slack in the slack of the print medium hanging vertically down from the outside circumference of the media roll; and a controller that controls the media conveyance unit to convey the print medium, controls the slack detector to detect the slack while the print medium is conveyed by the media conveyance unit, drives the reel driver at a last speed used in a previous sequence when the amount of slack is detected to be between a first threshold and a second threshold that is less than the first threshold, and when the slack is detected to be less than the second threshold, starts driving the reel driver at a second speed if the reel driver is being driven at a first speed, the second speed being greater than the first speed, and stops driving the reel driver if the reel driver is being driven at the second speed, wherein, the slack detector has a first detection unit that detects whether or not the slack is less than the first threshold, and a second detection unit that detects whether or not the slack is less than the second threshold; and the first detection unit is located vertically below the second detection unit, and wherein, the first detection unit and the second detection unit are transmissive photosensors having an emitter and a photodetector that detects light emitted from the emitter;

the amount of slack being detected from the amount of light detected by the photodetector.

2. The printing device described in claim 1, wherein:

the controller, when stopping driving the reel driver when slack less than the second threshold is detected, stops the media conveyance unit when the amount the media conveyance unit is driven after the reel driver is stopped exceeds a specific amount.

3. The printing device described in claim 2, further comprising:

a print unit that prints on the print medium;

the controller controlling the print unit to print based on an acquired print job, when stopping driving the reel driver when slack less than the second threshold is detected, stops the reel driver, then acquires the printable length, which is the length of the print medium the media conveyance unit can convey after the reel driver stopped, and continues printing if the acquired print job can be printed on the print medium of the acquired printable length.

4. A control method of a printing device including a media conveyance unit that conveys a print medium;

a reel spindle that supports a media roll of the print medium wound into a roll;

a reel driver that drives the reel spindle and turns the media roll; and a slack detector that detects the amount of slack in the slack of the print medium hanging vertically down from the outside circumference of the media roll;

the control method comprising:

conveying the print medium by the media conveyance unit;

detecting the slack by the slack detector while the print medium is conveyed;

driving the reel driver at a last speed used in a previous sequence when the amount of slack is detected to be between a first threshold and a second threshold that is less than the first threshold; and when the slack is detected to be less than the second threshold, starting driving the reel driver at a second speed if the reel driver is being driven at a first speed, wherein the second speed is greater than the first speed, and stopping driving the reel driver if the reel driver is being driven at the second speed, wherein, detecting the slack further comprises detecting whether or not slack is less than a first threshold using a first detection unit and detecting whether or not slack is less than a second threshold hold using a second detection unit, where the first detection unit is located vertically below the second detection unit; and wherein, the first detection unit and the second detection unit are transmissive photosensors having an emitter and a photodetector that detects light emitted from the emitter and detecting the amount of slack is detected from the amount of light detected by the photodetector.

* * * * *